United States Patent [19]

Fink et al.

[11] 4,014,085

[45] Mar. 29, 1977

[54] STRING UP AND SHUTDOWN PROCESS FOR A YARN TEXTURIZING APPARATUS

[75] Inventors: Roger H. Fink; William D. Porter, both of Asheville, N.C.

[73] Assignee: Akzona Incorporated, Asheville, N.C.

[22] Filed: Oct. 24, 1974

[21] Appl. No.: 517,787

[52] U.S. Cl. ..... 28/72.14

[51] Int. Cl.[2] ..... D02G 1/12

[58] Field of Search ..... 28/72.11, 72.12, 72.14

[56] References Cited

UNITED STATES PATENTS

| | | | |
|---|---|---|---|
| 3,778,872 | 12/1973 | Newton | 28/72.14 X |
| 3,842,468 | 10/1974 | Harrison | 28/72.12 X |
| 3,895,420 | 7/1975 | Sturtz et al. | 28/72.14 |

*Primary Examiner*—Robert R. Mackey
*Attorney, Agent, or Firm*—Craig & Antonelli

[57] ABSTRACT

A method for texturizing synthetic thermoplastic yarn in a bulking apparatus wherein a heated, dry gas is employed to convey a yarn into a bulking chamber to form a compact mass of yarn. The process is characterized in that an auxiliary gas is introduced into the bulking apparatus at a lower temperature than that of the heating gas to convey the yarn during start-up and/or shutdown of the apparatus to avoid over-heating and fusion of the yarn, and to thereby prevent plugging of the apparatus.

16 Claims, 3 Drawing Figures

STRING UP AND SHUTDOWN PROCESS FOR A YARN TEXTURIZING APPARATUS

BACKGROUND OF THE INVENTION

This invention relates to a method and apparatus for controlling an apparatus for texturizing multifilament yarn made of synthetic polymeric materials wherein the filaments of the yarn are pneumatically conveyed into a bulking chamber to form a compacted yarn mass and in particular, to a method and apparatus for controlling startup and shutdown of the apparatus as well as monitoring of faults in the bulking continuous operation.

Heretofore, many processes and apparatus have been developed for texturizing yarn made of thermoplastic polymeric materials by the employment of fluid jets or the like pneumatic means. Many of these prior developments have been relatively successful in providing bulky voluminous yarn having a degree of crimp uniformity and improved dyeing characteristics suitable for use in the production of textile fabrics, carpets and the like. The apparatus employed for carrying out these known processes is complex and often requires elaborate control systems to regulate the operation of the apparatus, especially during startup and shutdown.

Because of the advantages found in these pneumatic processes for producing texturized yarns, particularly the high yarn processing speeds, the need for such control systems for operating the apparatus have been accepted by the textile industry.

In the known processes for bulking yarn pneumatically, an initially straight and pre-drawn yarn which may be untwisted or slightly twisted is subjected to a turbulent heated fluid such as steam in such a manner that the individual filaments of the yarn are looped, coiled or crimped and the yarn is heat-set in this condition. The individual filaments are in this manner formed into a bulky wool-like product wherein each of the filaments in a relaxed condition exhibit a plurality of crimps or loops along a given length. Such crimps are usually offset and out of phase with each other in a random manner.

In order to ensure the provision of uniform crimps, bulking chambers are often employed to receive yarn from an aspirator jet to cause the formation of a compact mass of yarn or yarn plug which is continuously pushed or otherwise removed from the bulking chamber.

U.S. Pat. No. 3,373,470 describes a process for a stuffer-type crimping of thermoplastic filaments wherein the filaments are introduced into one end of an elongated confined space or bulking chamber by a stream of fluid such as steam under pressure and at a temperature sufficient to set the filaments. The filaments are tightly packed within the confined space by controllably releasing part of the fluid from the confined space laterally of the confined space at a position spaced from the other end and the packed filaments are then forced through the space to the other end under pressure by the remaining portion of fluid which exhausts with the yarn. The confined space required for this process is defined by a metal spring having gaps between the convolutions thereof. In this apparatus, the yarn is propelled by the action of the fluid from a nozzle through a tubular passage and then into the interior of the spring. The spring is curved to a desired extent to obtain optimum compacting of the yarn therein.

Additional apparatus and processes for texturizing synthetic yarns pneumatically are disclosed in U.S. Pat. Nos. 3,343,240 and 3,576,058. In the processes disclosed in each of these patents, steam is discloded as being a suitable fluid for conveying the filaments of the yarn into a zone wherein the yarn undergoes compression. An especially effective process and apparatus for texturizing yarns by aspirating the yarn into a bulking chamber is also described in the application of Brewster Eskridge, et al executed on even date herewith Ser. No. 517,802 Oct. 24, 1974. )

During the start-up of such processes, the thermoplastic yarn may become overheated by the heated gas and consequently, the filaments of the yarn may become fused together or become sufficiently tacky to stick to each other and thereby cause plugging of the bulking chamber or other zone wherein the yarn is compacted. Also, during emergency stoppage of the apparatus due to a yarn breakage or the like breakdowns or during scheduled shutdown of the apparatus, the yarn again may become overheated by the steam and/or the heat retained in the apparatus and consequently there is a risk of the yarn again plugging the apparatus.

SUMMARY OF THE INVENTION

The present invention provides a method for controlling the operation of an apparatus and process for texturizing synthetic thermoplastic yarns wherein a gas at a lower temperature, preferably an unheated gas, is introduced into the pneumatic apparatus in place of the heated gas such as steam during start-up and shutdown in order to avoid overheating of the yarn and the resultant fusion of the filaments which causes plugging of the apparatus.

More particularly, in accordance with this invention, it has been found that the injection of compressed, unheated air into an aspirator or bulking jet to facilitate pneumatic conveying of the yarn into a bulking chamber or other zone wherein the yarn filaments are formed into a compact yarn mass, for a relative short period of time, for example, from about 2 to 15 seconds, sufficiently cools the yarn and the apparatus to avoid overheating of the yarn and the resultant fusion of the filaments which causes plugging of the apparatus. Also, during string-up, the compressed air prevents fusion of the filaments and advantageously also provides a means for rapidly inserting the yarn into the pneumatic apparatus to thereby avoid a cumbersome manual string-up procedure.

In particular, this invention contemplates a method for controlling a process for texturing multifilament synthetic polymeric yarn wherein the yarn is passed in a heated gas stream to a bulking chamber in which the yarn filaments are caused to impinge against each other and to thereby form a compact yarn mass and wherein during start-up and/or shutdown of the process, a stream of unheated air or similar inert gas is injected in place of the heated gas to pneumatically convey the yarn through the aspirator or bulking jet and into the bulking chamber; the stream of air being introduced in the aspirator jet and bulking chamber for a sufficient period during shutdown of the process to effect cooling of the yarn and cooling of the adjacent surfaces of the apparatus to thereby prevent fusion of the filaments of the yarn.

This invention is also directed to an apparatus for effecting start-up, shutdown and control of the pneumatic apparatus for the texturizing of synthetic polymeric yarns which includes a source of compressed air or like gas, conduit means connecting said source to the gas inlet of the pneumatic apparatus, valve means in said conduit means for initiating and for stopping the flow of air therein and control means operatively associated with said pneumatic apparatus for causing the air to be injected into the pneumatic apparatus in place of the heated gas during start-up and shutdown of said apparatus.

In general, the heated gas used to aspirate the yarn in pneumatic bulking processes is a dry gas such as superheated steam or compressed air. Superheated steam preferably is used. This steam has a pressure of from about 50 to 100 psig. and a temperature on the order of 200° to about 275° C. The preferred pressure for processing of nylon 6 carpet yarn is from about 70 to 80 psig. and the preferred temperature is from 220° to 240° C. Usually, the temperature of the steam is above the melting point of the yarn since heat losses in the system and the short residence time of the yarn with the steam prevent the yarn from being raised to this temperature.

Compressed air suitable for heating and conveying the yarn generally will be compressed to from 50 to 100 psig. and will be heated at the same temperature of the superheated steam, that is, from 200° to 275° C.

The lower temperature gas which is employed in place of the heated gas usually has a pressure on the order of from 50 to 100 psig. and a temperature ranging from ambient to 150° C.; preferably unheated, compressed air at ambient temperatures is employed. It will be appreciated, however, that other inert gases that may be used include carbon dioxide, argon, nitrogen, helium, etc.

After the yarn plug or mass has been pushed from the bulking chamber or compression zone, the yarn plug, while still intact, may be guided through a tubular conduit to a plug guide where the yarn is removed from the plug by a takeup device at a rate which is 15 to 25% slower than the feed rate into the aspirator jet. Sufficient tension is supplied to the yarn to cause it to stretch out to a length less than the original length and to pull the filaments back into a yarn bundle.

In one embodiment of this invention, formation of the plug within the bulking apparatus can be controlled by regulating the position of the end of the plug pushed out of the bulking chamber. The plug is moving at a rate on the order or 1/200 of the yarn input rate in the tubular conduit or like means for guiding the yarn. The plug is directed into a plug guide defining a yarn accumulation chamber wherein a yarn sensing means, e.g. feeler elements, contact the yarn. When the plug moves past a high yarn level in the accumulation chamber due to failure of the yarn take-up device to remove the yarn bundle at the required rate or due to break in the yarn entering the take-up device, the yarn feeler element closes a switch and thereby causes the apparatus to shutdown. If the yarn plug recedes towards a low yarn level near the inlet of the plug guide and accumulation chamber due to failure of the aspirator jet to deliver the yarn at a required rate or due to a break in the yarn entering the jet, another feeler element and associated switch are actuated to cause shutdown. A control system of this type is described in greater detail in the application of Roger H. Fink, executed on even date herewith (Ser. No. 517,786, filed Oct. 24, 1974.) In accordance with this invention, during this shutdown, the unheated air can also be introduced in place of the steam.

The method and apparatus of this invention will be further understood from the following detailed description and the accompanying drawing wherein.

DESCRIPTION OF THE PREFERRED EMBODIMENTS

Figure 1:
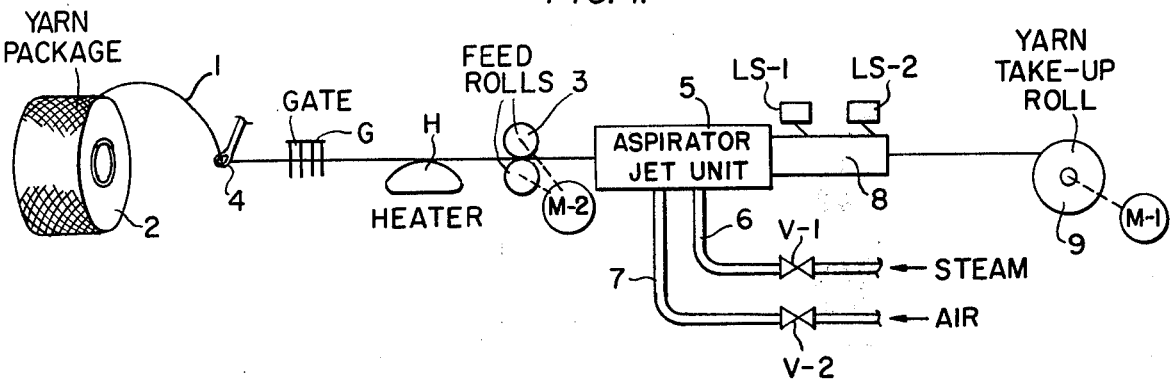
FIG. 1 represents a schematic diagram of an apparatus for carrying out the pneumatic texturizing of a synthetic polymeric yarn wherein the method and apparatus of the present invention are employed.

In FIG. 1, nylon feeder yarn 1 is drawn from a yarn package 2 by a pair of feed rollers 3 (driven by motor M-2) via guide 4, an air cylinder operated tension gate G (this gate remains open when the apparatus is running), over a plate heater H into an aspirator jet unit, generally designated by reference numeral 5. (The detailed construction of this unit, which includes a bulking chamber, is disclosed in the heretofore mentioned application of Brewster Eskridge, et al.) Superheated steam is supplied to the aspirator jet unit by steam inlet pipe 6 and valve V-1 and then discharges from a bulking chamber of this unit. The mass of compacted yarn or yarn plug formed within the bulking chamber is pushed into a plug 8. The yarn is withdrawn from the plug guide 8 in the form of a yarn bundle by a takeup roll 9 driven by moter M-1.

Limit switches LS-1 and LS-2 are provided on the tube guide 8 for determining the position of the end of the plug. This apparatus is described in greater detail in the heretofore noted application of Roger H. Fink.

The aspirator jet unit is also provided with an air inlet pipe 7 through which an auxiliary gas such as air may be introduced into the gas inlet of the jet in place of the superheated steam.

The yarn is initially delivered at a constant speed by the feed rollers to the aspirator jet. Delivery yarn speeds on the order of from 500 to 2,000 meters per minute may be used. Prior to entering the bulking jet, the yarn is preheated to a temperature on the order of from 150° to 200° C. by the plate heater or like heating device.

The yarn is aspirated into the bulking or aspirator jet by the venturi effect of the heated gas, that is superheated steam, and the yarn carried in the gas stream, then enters the bulking chamber. In normal, continuous operation, the temperature of the moving yarn is maintained below the sticking point to avoid the formation of separate coherent filament groups within the yarn as well as plugging of the apparatus.

In order to facilitate start-up of the apparatus, including stringing-up of the yarn, valve V-2 is used to control introduction of compressed air through pipe 7.

The following string-up procedure is employed:

1. Valve V-2 is opened and compressed air, 65 psig and 27° C. or ambient temperature is introduced into the aspirator jet via pipe 7.
2. The yarn, after being manually passed through guide 4, and gate G, and over plate H, is inserted into a gas inlet tube of the jet unit to be drawn in by the venturi effect created in the aspirator jet due to air flow through a nozzle provided therein.

3. After a length of yarn has passed through the aspirator jet, the bulking chamber and the plug guide, valve V-2 is closed and the yarn is secured to the take-up roller for forming a take-up package and inserted between feed rollers 3.

At this time, the apparatus shown in FIG. 1 may be started up by actuating the operation of the gate (the heater having been activated by a separate electrical circuit not shown), the feed rollers and the steam jet (by opening of valve $V_1$ ) and also the operation of the yarn take-up roll. Also, it is possible to start-up the apparatus, without the introduction of steam by introducing air for a short period of time for about 5 seconds. Moreover, a mixture of steam and air could be used to initiate start-up with the proportion of air in the mixture being in an amount that will reduce the temperature sufficiently to avoid overheating and fusion of the yarn filaments.

Although the yarn will become compacted and form a plug within the bulking chamber due to the impingement of the filaments of the yarn of each other and onto the walls of the bulking chamber, it is also possible to facilitate plug formation by holding a baffle device at the end of the bulking chamber to keep the yarn from blowing out until the yarn plug has formed therein.

Also, when the bulking apparatus is caused to stop, that is either by a scheduled shutdown or by an occurrence of a fault during the operation such as a break in the yarn or an end of the yarn plug being out of its proper position in the yarn guide, all elements of the apparatus are stopped and valve V-2 is is opened to allow introduction of the unheated gas.

In this manner, during start-up and shutdown, fusion of the thermoplastic polymeric filaments of the yarn is prevented to thereby avoid plugging in the nozzle of the aspirator jet and in the associated bulking chamber.

As heretofore described, during shutdown of the bulking apparatus the unheated air or other gas serves to cool the heated yarn as well as the surfaces within the aspirator jet and bulking chamber so that the residual heat is dissipated.

With respect to the yarn guide plug 8, it will be appreciated that this guide includes a tubular member having an open end for delivery of the compacted yarn mass in the form of a plug and an outlet for allowing the yarn to be removed in the form of a yarn bundle.

Limit switches, LS-1 and LS-2 are operatively associated with feeler elements (not shown) which extend into contact with yarn in the plug guide 8. These feeler elements are depressed by contacting the yarn plug within the guide. In the embodiment of the sensing means illustrated in the drawings, when the feeler element associated with limit switch LS-1 is in the depressed position that is pushed away from the interior of the tube guide, then the limit switch is maintained in an open position; whereas, the feeler element associated with the limiting switch LS-2 is biased in its raised position within the tubular guide element. Consequently, limit switch LS-2 is also in an open position. When the feeler elements associated with these limit switches are moved to cause actuation of the switches, then the apparatus is shut down in the same manner as when a scheduled stoppage is effected. It will be appreciated that depending on the control circuitry used to effect an on/off control of the texturizing apparatus, the limiting switches may be maintained in a closed position during normal operation.

Figure 2:
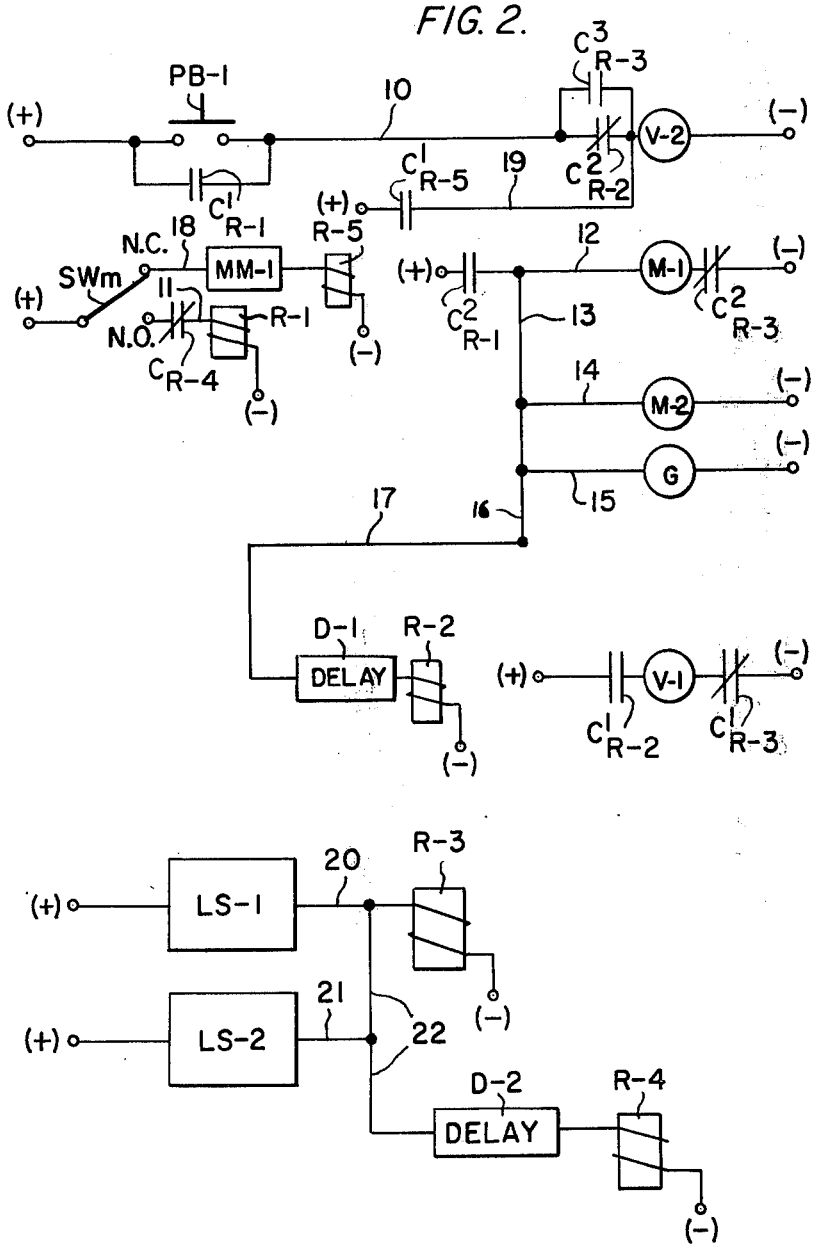
FIG. 2 is a typical electrical control circuit used in the method and apparatus of the present invention.

In FIG. 2, an electrical circuit for controlling the apparatus of FIG. 1 is further illustrated with the same elements being identified by like reference letters or numerals.

In this figure, PB-1 designates a push-button switch connected across a power source via line 10, normally closed relay contact $C^2_{R-2}$ and the normally closed solenoid operated valve V-2. Actuation of push-buttom switch causes valve V-2 to introduce air into the aspirator jet unit 5 during string-up. A main power switch $SW_M$, which is shown in the normally open position, is connected across the power source via normally closed relay contact $C_{R-4}$, line 11 and relay R-1, and is used to initiate operation of the yarn texturizing apparatus. This switch, in its closed position actuates relay R-1. This relay is operatively associated with relay contact $C^1_{R-1}$connected in parallel with push-button switch PB-1. Relay R-1 is also associated with normally open relay contact $C^2_{R-1}$, which contact is connected in parallel with several elements of the texturizing apparatus, i.e. contact $C^2_{R-1}$ is connected via line 12 to motor M-1 of the yarn take-up roll 9 and a normally closed relay contact $C^2_{R-3}$; via lines 13 and 14 to motor M-2 of the feed rolls 3; via lines 13 and 15 to a solenoid valve causing operation of gate G; via lines 13, 16, and 17 to delay means D-1 operatively associated with relay R-2.

Upon actuation of relay R-1, normally open contact $C^2_{R-1}$ is closed to thereby energize motor M-1 of the yarn takeup roll 9, the motor M-2 of feed rolls 3, and the opening of gate G. At the same time, delay means D-1 act to delay current flow for a predetermined period, e.g. 5 to 15 seconds, to relay R-2. Delay means D-1 is a "pure" delay, i.e. a delay which acts to delay energy flow for a preset period before allowing the energy to flow continuously. Relay R-2 is operatively associated with relay contacts $C^1_{R-2}$ connected to valve V-1 and relay contact $C^2_{R-2}$ connected to the normally closed, solenoid operated valve V-2.

Actuation of switch $SW_M$ also causes normally open contact $C^1_{R-1}$ to be closed by operation of relay R-1. As a result, the valve V-2 is opened to allow the introduction of compressed air into the aspirator jet unit. The introduction of air during the startup procedure is continued until delay D-1 causes energization of relay R-2 which in turn causes normally closed contact $C^2_{R-2}$ to open. Relay R-2 also closes normally open contact $C^1_{R-2}$ to thereby energize valve V-1. This energization causes the valve V-1 to open and to allow steam to be injected into the aspirator jet unit via pipe 6.

In order to shutdown the texturizing apparatus during a scheduled stoppage, switch $SW_M$ is moved to the open position shown in FIG. 2 to thereby de-energize relay R-1 and to thereby stop motors M-1 and M-2 controlling the takeup roll 9 and the feed rollers 3, respectively. Also, gate G closes.

At the time switch $SW_M$ is opened, a monostable multivibrator MM-1 is energized via line 18. This multivibrator has a normally low output, that is, it has a "one" (mono) stable state. Upon triggering, this device gets a high output for only a preset period of time, for example 5 seconds; that is, output current passes for a period of about 5 seconds. Then the multivibrator returns to its stable or low output state where there is no output current. During the high or "on" state, the multivibrator actuates relay R-5 which in turn causes operation of normally open contact $C^1_{R-5}$. This contact is connected to valve V-2, via line 19. Closing of this contact makes valve V-2 open to allow air to be introduced into the aspirator jet unit. Subsequently, upon the end of the preset period, that is about 5 seconds, the relay R-5 is de-energized and contact $C^1_{R-5}$ returns to its open position. In this manner, valve V-2 is again closed. At this time, the texturizing apparatus and the control apparatus are in the shutdown or "off" condition.

In order to provide shutdown during continuous operation of the texturizing apparatus due to a change in position of the end of the yarn plug within plug guide 8 or a break in the yarn in front of or behind the yarn guide 8, limit switches LS-1 and LS-2 are placed in parallel with relay R-3, via line 20 and lines 21 and 22, respectively. This relay may be energized by either one of the limit switches. R-3 is operatively associated with normally closed relay contacts $C^1_{R-3}$ and $C^2_{R-3}$ and normally open relay contact $C^3_{R-3}$. Upon energization of one of the limit switches normally closed contacts $C^1_{R-3}$ and $C^2_{R-3}$ are opened thereby causing de-energizing of motor M-1 of yarn take-up roll 9 and closing of valve V-1 in steam inlet pipe 6. Also, normally open contact $C^3_{R-3}$ is closed to energize and open valve V-2 which allows air to again be introduced into the aspirator jet unit 5.

A delay means D-2 is also connected in parallel with switches LS-1 and LS-2 via lines 20 and 22 and lines 21 and 22, respectively. This delay means is connected to relay R-4, which is operatively associated with the normally closed relay contact $C_{R-4}$.

When relay R-3 is actuated, the delay means D-2 is also actuated. This relay has a preset delay time of for example 5 seconds. At the end of this time, relay R-4 is energized. This relay opens normally closed contact $C_{R-4}$ which in turn shuts down the remaining elements of the texturizing apparatus by de-energizing relay R-1. Also, at this time, normally open relay contact $C^1_{R-1}$ is again allowed to open and thereby shut down valve V-2.

It will be understood that other switching circuits may be employed to effect the same type of control initiated by that shown in FIG. 2.

Figure 3:
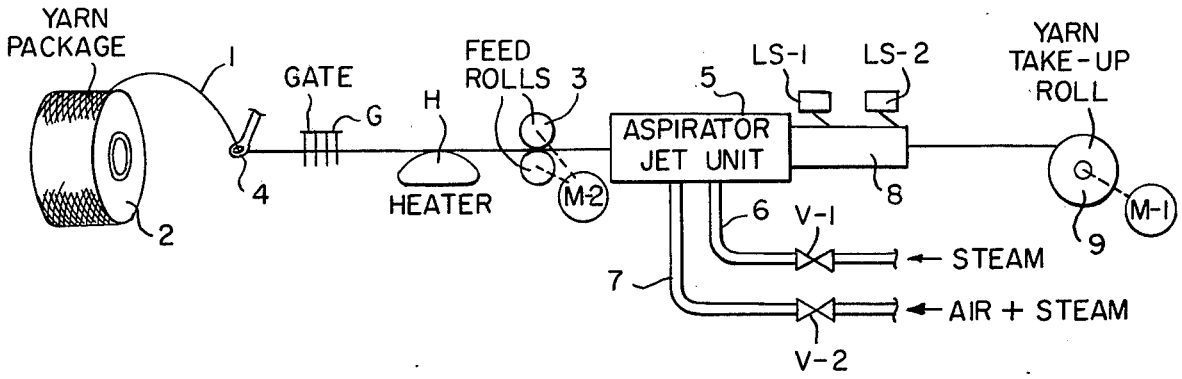
FIG. 3 represents a schematic diagram of an additional embodiment of the apparatus shown in FIG. 1.

In FIG. 3 there is shown a schematic diagram of an apparatus of the type shown in FIG. 1 with the exception that an air steam mixture is introduced via valve V-2 and air inlet pipe 7 into the aspirator jet unit 5.

It will be also understood that the control method and apparatus of this invention may be used with many types of texturizing apparatus wherein an aspirator jet is employed to introduce yarn into a bulking chamber or zone and that the texturizing apparatus heretofore described and illustrated in the drawing is to be considered as representative of such apparatus.

It will be appreciated that at the higher operating pressures, e.g. at 70 psig or above, the aspirating effect that occurs at the yarn inlet of the jet means is no longer apparent, i.e. the pressure goes from negative to positive during the bulking operation. In this case, lower pressure air is needed to initiate the string-up procedure.

While novel embodiments of the invention have been described, it will be understood that various omissions, modifications and changes in these embodiments may be made by one skilled in the art without departing from the spirit and scope of the invention.

We claim:

1. In a method for texturizing synthetic thermoplastic yarn in a bulking apparatus wherein a heated, dry gas is employed to convey a yarn into an initial portion of a bulking chamber to form a compact mass of yarn therein, the improvement which comprises introducing into said initial portion of said bulking chamber an auxiliary gas in place of and at a lower temperature than said heated gas during a short period of operation other than normal, continuous operation of said bulking apparatus to avoid overheating and fusion of the yarn within the initial portion of said bulking chamber and to thereby prevent plugging of the apparatus.

2. The method of claim 1, wherein said lower temperature is below the fusion point of said yarn.

3. The method of claim 2, wherein said heated dry gas is at a temperature above the fusion point of said yarn.

4. The method of claim 1, wherein said auxiliary gas is a mixture of said heated gas and and an unheated gas and the lower temperature is below the fusion point of said thermoplastic yarn.

5. The method of claim 1, wherein said auxiliary gas is unheated compressed air which is introduced into said bulking apparatus.

6. The method of claim 5, wherein said unheated compressed air is injected in said bulking apparatus for a period of from about 2 to about 15 seconds.

7. The method of claim 1, wherein said auxiliary gas is introduced into said initial portion of said bulking chamber during start-up of said apparatus to convey the yarn into said bulking chamber.

8. The method of claim 1, wherein the auxiliary gas is introduced into said initial portion of said bulking chamber during shutdown of said apparatus.

9. The method of claim 1, wherein said bulking apparatus includes an aspirator jet for pneumatically conveying said yarn into said bulking chamber and said auxiliary gas is introduced initially into said aspirator jet.

10. The method of claim 1, wherein a stream of said auxiliary gas is introduced into said apparatus for a period of from 2 to 15 seconds.

11. A method for controlling a process for the texturizing of multifilament synthetic polymeric yarn wherein the yarn is fed by a yarn feeder means into an aspirator jet supplied with a heated, dry gas, the yarn is passed in a stream of the heated gas to a bulking chamber in which the yarn filaments are caused to impinge against each other and to thereby form a compact yarn mass, and the yarn is withdrawn from the bulking chamber in the form of a yarn bundle by a take-up means, which comprises drawing the yarn from the feeder means into the aspirator jet and passing the yarn through the bulking chamber by introducing a gas at a lower temperature than said heated gas into said aspirator jet; securing the end of the yarn received from said bulking chamber onto a take-up device; initiating start-up of said process by introducing said heated dry gas into the aspirator jet and by simultaneously initiating operation of said feeder means and said take-up means and subsequently stopping the introduction of the lower temperature gas; and effecting shutdown of said process by stopping the introduction of heated gas into said jet, by deactivating said feeder means and said take-up means, and by again introducing the lower temperature gas into said aspirator jet and bulking chamber for a predetermined short period of time to prevent overheating of said yarn and plugging of said apparatus.

12. The method of claim 11, wherein said gas at a lower temperature is unheated compressed air and said heated gas is superheated steam.

13. The method of claim 12, wherein said lower temperature air is also introduced into said jet during start-up of said process for a predetermined short period of time.

14. The method of claim 12, wherein said lower temperature air is introduced in place of said steam during an initial period of the start-up of said process.

15. The method of claim 11, wherein said gas at a lower temperature is introduced into said jet for a period of from 2 to 15 seconds.

16. In a method for texturizing synthetic thermoplastic yarn in a bulking apparatus wherein a heated, dry gas is employed to convey a yarn into an initial portion of a bulking chamber to form a compact mass of yarn therein, the improvement which comprises introducing into said initial portion of said bulking chamber an auxiliary gas at a lower temperature than said heated gas to avoid overheating and fusion of the yarn within the initial portion of said bulking chamber and to thereby prevent plugging of the apparatus, said auxiliary gas being introduced into said initial portion of said bulking chamber during start-up and shutdown of said apparatus.

* * * * *